US005692330A

United States Patent [19]

Anderson, Jr.

[11] Patent Number: 5,692,330

[45] Date of Patent: Dec. 2, 1997

[54] MULTIPLE IMAGE DISPLAY DEVICE

[76] Inventor: Tazwell L. Anderson, Jr., 3690 Northside Dr., Atlanta, Ga. 30305

[21] Appl. No.: 541,445

[22] Filed: Oct. 10, 1995

[51] Int. Cl.[6] ..... G09F 11/02

[52] U.S. Cl. ..... 40/505; 40/473; 40/493

[58] Field of Search ..... 40/473, 493, 503–506; 345/108, 110

[56] References Cited

U.S. PATENT DOCUMENTS

| | | | |
|---|---|---|---|
| 2,093,530 | 9/1937 | Walmsley | 40/504 X |
| 2,941,322 | 6/1960 | Harmon | 40/473 |
| 3,643,359 | 2/1972 | Nowicki . | |
| 3,706,148 | 12/1972 | Johnston . | |
| 3,798,811 | 3/1974 | Rockola . | |
| 3,983,648 | 10/1976 | Hunter Jr. . | |
| 4,002,022 | 1/1977 | Lopez . | |
| 4,189,859 | 2/1980 | Ahlgren . | |
| 4,528,763 | 7/1985 | Algren . | |
| 4,638,580 | 1/1987 | Giannetti et al. . | |
| 4,759,140 | 7/1988 | Roberts et al. . | |
| 5,003,716 | 4/1991 | Dyar . | |
| 5,022,172 | 6/1991 | Kawahara et al. . | |
| 5,161,421 | 11/1992 | Stigsson . | |
| 5,233,772 | 8/1993 | Bergeron et al. . | |
| 5,255,463 | 10/1993 | Werner . | |
| 5,255,465 | 10/1993 | Perez . | |
| 5,259,135 | 11/1993 | Bannister et al. . | |
| 5,315,776 | 5/1994 | Strawbridge et al. . | |

FOREIGN PATENT DOCUMENTS

| | | |
|---|---|---|
| 0514797A1 | 11/1992 | European Pat. Off. . |
| 2637109 | 3/1990 | France . |

*Primary Examiner*—Kenneth J. Dorner
*Assistant Examiner*—Cassandra Davis
*Attorney, Agent, or Firm*—Lerner, David, Littenberg, Krumholz & Mentlik

[57] ABSTRACT

A multiple image display device provides a seamless appearance while driving multiple rows of display panels arranged in adjacent columns. The display panels are driven through interconnection with a plurality of motor assemblies coupled to the bottom of the lower display panels and the top of the upper display panels. This enables the interconnection of multiple display panels in longitudinal alignment with minimum space therebetween to provide the seamless appearance. Intermediate support members carry the load of large display panels which would otherwise be impractical to assemble in a display device.

31 Claims, 5 Drawing Sheets

MULTIPLE IMAGE DISPLAY DEVICE

FIELD OF THE INVENTION

The present invention relates in general to a multiple image display device and method therefor, and more particularly, to advertising signs of the billboard type in which a plurality of information bearing panels rotate intermittently in unison to compose different scenes that may be pictorial, artistic or informational.

Advertising signs have become a highly used means of passing on advertising messages to the general public. As a result, these advertising signs may be found today in practically any location where there is free space. These advertising signs have, over the years, taken many forms to provide the greatest flexibility in conveying advertising messages and the like. For example, there is known from Ahlgren, U.S. Pat. No. 4,189,859 a display device including a plurality of elongated prisms which are individually rotatable for displaying any one of three different images, see also Perez, U.S. Pat. No. 5,255,465.

As advertisers demand the display of greater and greater amounts of information, there is the increasing need for developing advertising signs of larger size with greater message capacity. Due to various constraints, known advertising signs have generally been limited to a single row of rotatable display panels such as prisms and the like. Although attempts have been made in constructing advertising signs having multiple rows, such signs have suffered from a number of disadvantages. In particular, it has been required that the upper and lower rows of display panels be separately rotated. To this end, one or more motors have been mounted to the frame supporting the display panels at a location between adjacent rows. This construction has necessitated the provision of a relatively large space between the upper and lower rows thereby providing the advertising sign with the unsightly appearance of discontinuity of the overall displayed information. To this end, there is the unsolved need of providing an advertising sign constructed from multiple rows of display panels which have a seamless appearance to the observer, while at the same time, providing individually rotatable display panels. Accordingly, it can be appreciated that although the advertising display art, and/or the multi-site advertising display art is a particularly crowded art, even the smallest variation and improvement may be of great significance as is the case of the present invention.

SUMMARY OF THE INVENTION

It is broadly one object of the present invention to provide a multiple image display device which can be constructed in varying sizes to accommodate the need of the advertiser in displaying multiple images of different scenes that may be pictorial, artistic or informational.

Another object of the present invention is to provide a multiple image display device having plural rows of display panels which define an image display area having a seamless appearance.

Another object of the present invention is to provide a multiple image display device wherein the displayed images may be easily changed by selective rotation of one or more display panels.

Another object of the present invention is to provide a multiple image display device which is constructed from a plurality of prism-like display panels.

Another object of the present invention is to provide a multiple image display device which provides intermediate load bearing support for the display panels.

In accordance with one embodiment of the present invention there is described a display device for displaying changeable images, the device comprising a plurality of display members arranged in lower and upper areas providing a display area having a changeable image upon rotation of at least one of the display members, rotating means operatively coupled to the lower ends of the display members within the lower area and to the upper ends of the display members within the upper area for rotating at least one of the display members.

In accordance with another embodiment of the present invention there is described a display device for displaying changeable images, the device comprising a plurality of first display members arranged in columns for rotation about an axis thereof, a plurality of second display members arranged in columns for rotation about an axis thereof, the second display members arranged in adjacent end-to-end alignment with corresponding ones of the first display members thereby providing a display area having a seamless appearance between the first and second display members, support means for rotationally supporting the aligned opposing ends of the first and second display members, and rotating means operatively coupled to the lower ends of the first display members and the upper ends of the second display members for independent rotation of the first display members relative to the second display members, whereby the display area has a changeable image upon rotation of at least one of the display members.

In accordance with another embodiment of the present invention there is described a display device having a seamless appearance for displaying a plurality of changeable images, the device comprising a frame, a plurality of elongated multi-sided first display members within the frame each having a longitudinal rotational axis arranged in adjacent columns within a first row thereof, a plurality of elongated multi-sided second display members within the frame each having a longitudinal rotational axis arranged in adjacent columns within a second row thereof, the second display members arranged in adjacent longitudinal alignment with corresponding ones of the first display members thereby providing a display area having a seamless appearance, means for rotationally supporting the adjacent ends of the longitudinally aligned first and second display members, first rotation means operatively coupled to the lower ends of the first display members for rotation thereof, and second rotation means operatively coupled to the upper ends of the second display members for rotation thereof independently of the first display members, whereby the display device has a changeable image upon rotation of at least one of the first and second display members.

In accordance with another embodiment of the present invention there is described a method for changing the images of a display device, the method comprising arranging a plurality of display members in lower and upper areas, to provide a display area, rotating at least one of the display members in the lower area at the lower end thereof and rotating at least one of the display members in the upper area at the upper end thereof to change the image within the display area.

BRIEF DESCRIPTION OF THE DRAWINGS

The above description, as well as further objects, features and advantages of the present invention will be more fully understood with reference to the following detailed description of a multiple image display device, when taken in conjunction with the accompanying drawings, wherein.

DETAILED DESCRIPTION OF THE PREFERRED EMBODIMENTS

Figure 1:
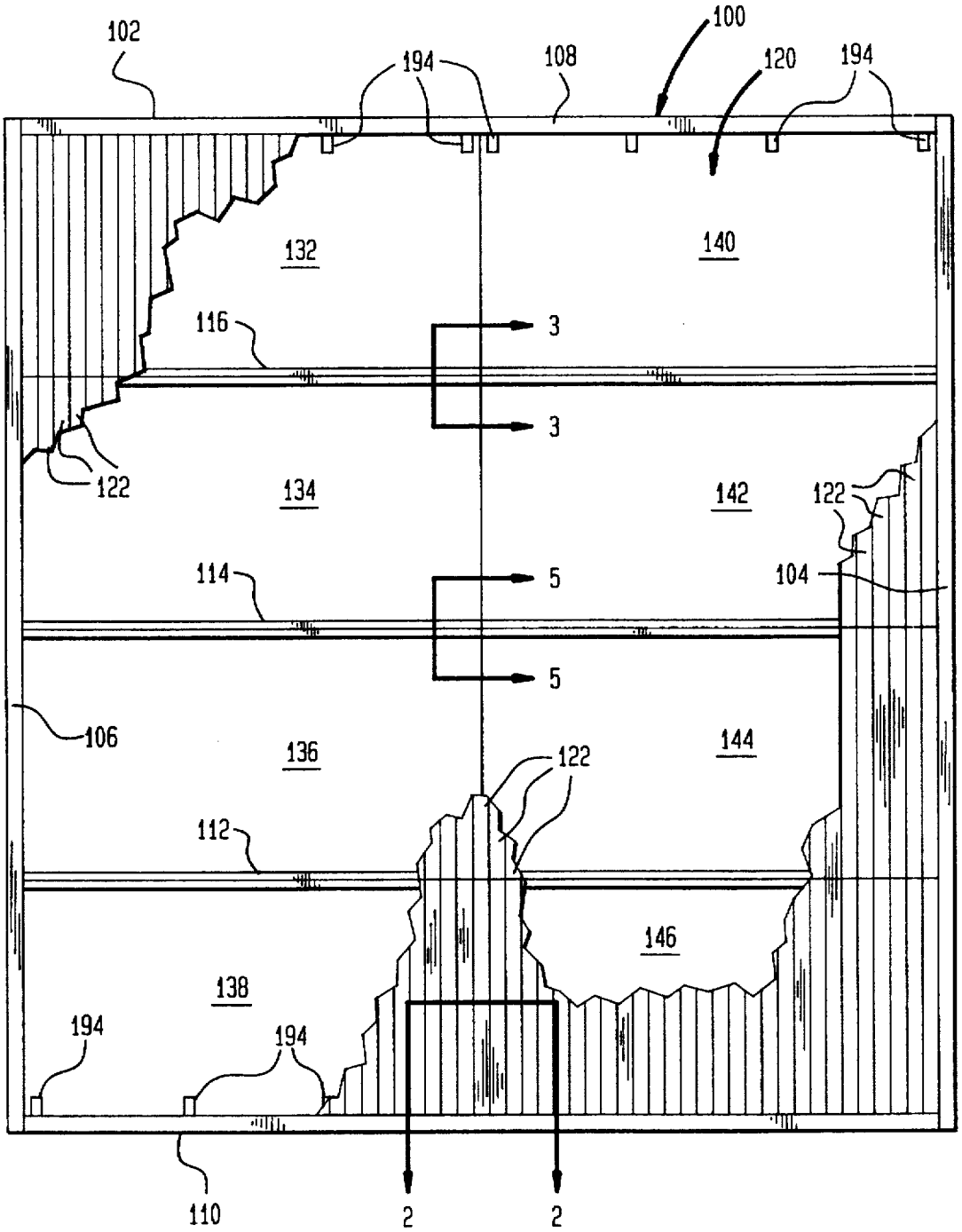
FIG. 1 is a front view, in partial cross-section, of a multiple image display device constructed in accordance with one embodiment of the present invention.

Turning now to the drawings, wherein like reference numerals represent like elements, there is illustrated in FIG. 1 a multiple image display device constructed in accordance with one embodiment of the present invention and generally designated by reference numeral 100. The display device 100 is initially constructed from a frame 102 formed from side members 104, 106, top member 108, bottom member 110 and intermediate members 112, 114, 116. The frame 102 defines a generally rectangular open area 120 to provide the extent of the image display area. As will be understood from a further description of the display device 100 in accordance with the present invention, the opening area 120 may be dimensioned to accommodate the needs of the user and the size of the particular free space available for mounting the display device. By way of illustrative example, the opening area 120 is approximately 60 feet high by 55 feet wide.

Figure 2:
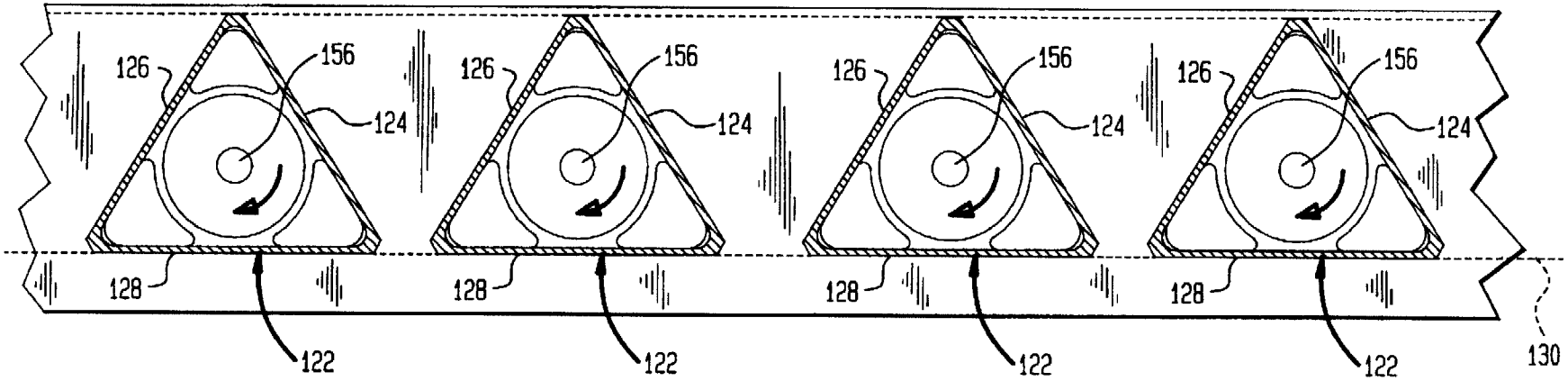
FIG. 2 is a cross-sectional view taken along Line 2—2 in FIG. 1, showing the display panels constructed from prism-like members.

The images to be displayed are carried by a plurality of display panels 122 which are constructed in the nature of prism-like members. As shown in FIG. 2, the display panels 122 have a triangular cross-section to provide three image supporting surfaces 124, 126, 128. A segment of a particular image to be displayed may be adhered to one of the image supporting surfaces 124, 126, 128 by suitable means known in the art. The image sections are so arranged so that the complete image to be displayed is observed when the display panels 122 are oriented having one of the image supporting surfaces 124, 126, 128 arranged in a common plane 130. In this regard, by rotating the display panels 122 so as to position a different image supporting surface 124, 126, 128 in the common plane 130, a different image may be displayed. Accordingly, the use of a prism-like member having three image supporting surfaces 124, 126, 128 enables changing of the displayed image through each 120° of rotation.

Although the display device 100 has been described with respect to the particular construction of a display panel 122 as shown in FIG. 2, it is to be understood that other display panels may also be employed in accordance with the present invention. For example, display panels having replaceable image supporting surfaces such as known from Ahlgren, U.S. Pat. No. 4,528,763 may be incorporated into the display device of the present invention. In this regard, the Ahlgren display panels are preferred in that they include easily removable image supporting surfaces which can be changed to alter the image to be displayed.

The display panels 122 are arranged adjacent one another in a plurality of rows and columns to define eight individual display areas 132, 134, 136, 138, 140, 142, 144, 146. As will become clear from a further description of the display device 100 in accordance with the present invention, the display panels 122 are operatively coupled to form four display quadrants. The first display quadrant is formed from the display panels 122 within display areas 132, 134. The second quadrant is formed from the display panels 122 within display areas 136, 138. The third quadrant is formed from the display panels 122 within display areas 140, 142. The fourth quadrant is formed from the display panels 122 within display areas 144, 146.

As it should be appreciated, the individual display panels 122 are supported by the frame 102 for rotation about their longitudinal axis. Due to the overall length of the display panels 122 within the first display quadrant, i.e., display areas 132, 134 being approximately 15 feet each, it is desirable to provide an intermediate support for the display panels by means of intermediate member 116. In the absence of intermediate member 116, the entire weight load of the display panels 122 within the first display quadrant would be carried by intermediate member 114. In addition to the weight distribution problem, it is difficult to fabricate a display panel 122 with the appropriate tolerances having a length greater than about 15 feet. In addition, individual display panels 122 of lengths generally greater than about 15 feet will also cause problems with respect to wind loads. It is therefore preferable that large display quadrants be divided into multiple display areas having display panels 122 of shorter length which are operatively coupled together. In this regard, the display panels 122 within a given display quadrant may be joined together in end-to-end relationship for simultaneous rotation during operation of the display device 100. In the case where the display panels 122 are of limited length, for example about fifteen feet, is not necessary to provide intermediate support.

Figure 3:
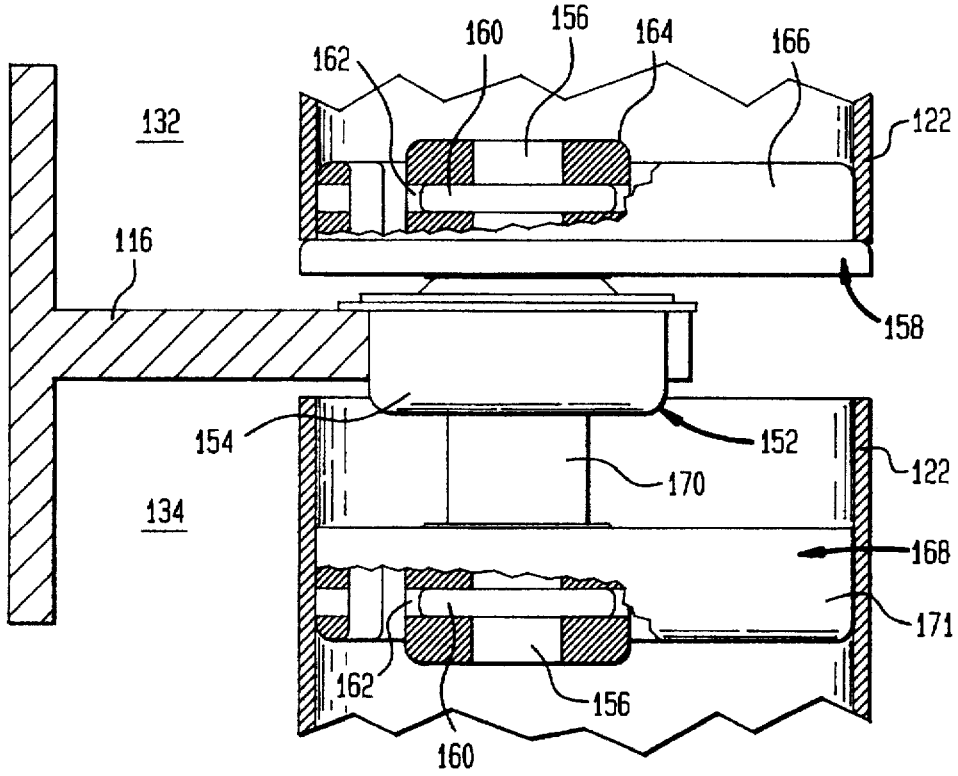
FIG. 3 is a cross-sectional view taken along Line 3—3 in FIG. 1 showing an assembly for rotationally supporting a pair of display panels within a common row in end-to-end relationship.

Referring to FIG. 3, there is disclosed a journal assembly 152 for rotationally maintaining a pair of opposing display panels 122 within common quadrant in end-to-end relationship. The journal assembly 152 is constructed to include a housed bearing 154 supported within intermediate member 116. An elongated shaft 156 extends rotationally supported through the bearing 154 on either side of the intermediate member 116. A load bearing carrier 158 is rotationally connected to the upper end of shaft 156 by means of a slotted spring pin 160 which extends through an opening within the shaft and is captured within a slot 162 within a hub 164 of the load bearing carrier. The load bearing carrier 158 is provided with a projecting inner member 166 which is sized and shaped to be received within the interior of the lower end of an adjacent display panel 122. As shown, the base of the load bearing carrier 158 is sized to support the display panel 122 thereon. In this regard, rotation of the display panel 122 will, in turn, cause rotation of shaft 156.

The lower end of the shaft 156 supports a similar carrier 168 which is attached to the shaft also by means of a slotted spring pin 160. The carrier 168 is spaced from the bearing 154 by means of a spacer 170. By means of the spacer 170, the projecting inner member 171 of the carrier 168 may be received within the upper end of the display panel 122. As such, the carrier 168 is not provided with a supporting ledge for the display panel 122 as in the case of the load bearing carrier 158. As specifically noted, the intermediate member 116 will carry the load of the display members 122 within the display areas 132, 140 thereby enabling the construction of larger display devices 100. It should be appreciated that rotation of the display panels 122 within display areas 132, 140 will, in turn, cause rotation of the display panels 122 within the display area 134, 142 by means of the common rotating shaft 156 being operatively coupled therebetween by means of the load bearing carrier 158 and carrier 168.

From the foregoing description, the display panels 122 within a given quadrant may be rotationally joined together by means of the journal assembly 152 to provide simultaneous rotation of the display panels about their longitudinal axis. As the bearing 154 is relatively small, the space between the ends of the display panels 122 will likewise be relatively small, thereby providing a seamless appearance to the observer. In addition, the use of the journal assembly 152 enables the construction of the display quadrant from multiple display panels 122 joined in end-to-end relationship thereby overcoming the aforementioned problems of wind loads, weight distribution problems, manufacturing tolerances and the like.

Figure 4:
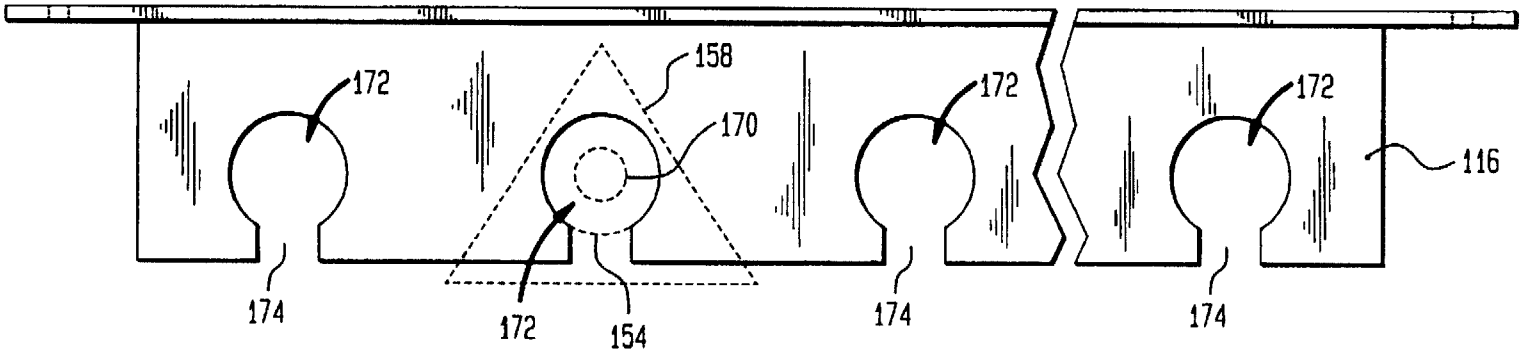
FIG. 4 is a top plan view of an intermediate load bearing member for rotationally supporting the display panels.

A simple method of installing the journal assembly 152 to the intermediate member 116 for support of the display panels 122 may be devised. In this regard, as shown in FIG. 4, the intermediate member 116 is provided with a plurality of key hole shaped openings 172 arranged opening along the forward edge of the intermediate member. The upper display panel 122 is first connected to the upper half of the journal assembly 152, i.e., load bearing carrier 158 and inner member 166, as shown in FIG. 3. The lower half of the journal assembly 152, i.e., carrier 168 and inner member 171 is inserted into the upper end of the lower display panel 122. The joined upper and lower display panels 122 are slid such that the spacer 170 slides through the slot 174 of the key hole shaped opening 172. The journal assembly 152 is then pushed downwardly such that the bearing 154 is snugly received within the main portion of the key hole shaped opening 172 as shown by the dashed lines in FIG. 4. The aforementioned construction enables the journaling of two adjacent display panels 122 in end-to-end relationship while being supported by an intermediate member 116.

Figure 5:
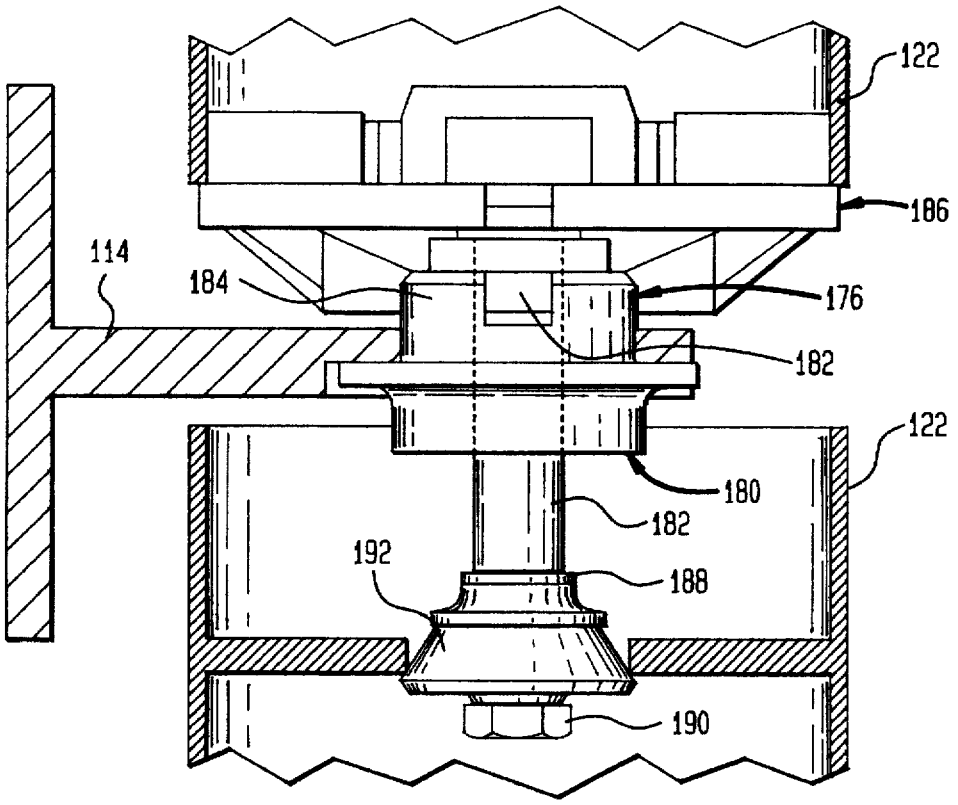
FIG. 5 is a cross-sectional view taken along Line 5—5 in FIG. 1 showing an assembly for rotationally supporting a pair of display panels within adjacent rows in end-to-end relationship.

Referring to FIG. 5, there is disclosed a journal assembly 176 for rotationally maintaining a pair of opposing display panels 122 within adjacent quadrants in end-to-end relationship. Unlike journal assembly 152, journal assembly 176 allows the display panels 122 to be independently rotated about their longitudinal axis. Journal assembly 176 is constructed to include a housed bearing 180 which is mounted within a recess to the lower surface of intermediate member 114 for rotationally supporting a shaft 182 extending therethrough. A spacer 184 is arranged about the shaft 182 supported on the upper surface of the intermediate member 116. A load bearing carrier 186, of similar construction to load bearing carrier 158, is rotationally supported by the shaft 182 for rotation therewith. Supported at the free end of the shaft 182 between a washer 188 and a retaining bolt 190 is a conical shaped guide 192. The guide 192 is received within the open end of display panel 122 to maintain the display panel in position while being rotated about its longitudinal axis as to be described hereinafter.

The guide 192 is mounted about the shaft 182 for free rotation independent of any rotation of the shaft. That is, the guide 192 is rotationally supported upon the shaft 182 as opposed to being coupled thereto for concurrent rotation. In this regard, the guide 192 will freely rotate about shaft 182 when the shaft is stationary, while at the same time, the guide will remain stationary while the shaft 182 is rotated by means of the load bearing carrier 186. It should therefore be appreciated that rotation of the aligned display panels 122 can be controlled independently of each other.

From the foregoing description, the display panels 122 within adjacent upper and lower display quadrants may be independently rotationally joined together by means of the journal assembly 176. As the bearing 180 is relatively small, the space between the ends of the display panels will likewise be relatively small, e.g., about two inches, thereby providing a seamless appearance to the observer. In addition, the use of the journal assembly 176 enables the construction of the display quadrants from multiple display panels 122 of smaller lengths joined in end-to-end relationship thereby overcoming the aforementioned problems of wind loads, weight distribution problems, manufacturing tolerances and the like. The aforementioned seamless appearance of the display device 100 is attributable to the use of the journal assembly 176 made possible by rotationally driving the display members 122 adjacent their upper ends within display areas 132, 140 and adjacent their lower ends within display areas 138, 146.

As shown in FIG. 1, a plurality of motor assemblies 194 are supported along the length of the top member 108 and bottom member 110 of frame 102. In the particular embodiment illustrated, sixteen motor assemblies 194 are provided, four for each display quadrant. That is, four motor assemblies 194 are operative for rotation of display panels 122 within display areas 132, 134, four motor assemblies for display areas 140, 142, four motor assemblies for display areas 136, 138 and four motor assemblies for display areas 144, 146. The display panels 122 within each of the aforementioned four quadrants are controlled independently of each other. Thus, one or more display panels 122 within one quadrant may be rotated while the display panels in another display quadrant may remain stationary. In addition, by having four motor assemblies 194 for a given display quadrant, the display panels 122 within the display quadrant may be controlled in four separate groups of equal or unequal numbers of display panels. It is to be understood, however, that a greater or lesser number of motor assemblies 194 may be used in accordance with the present invention.

Figure 6:
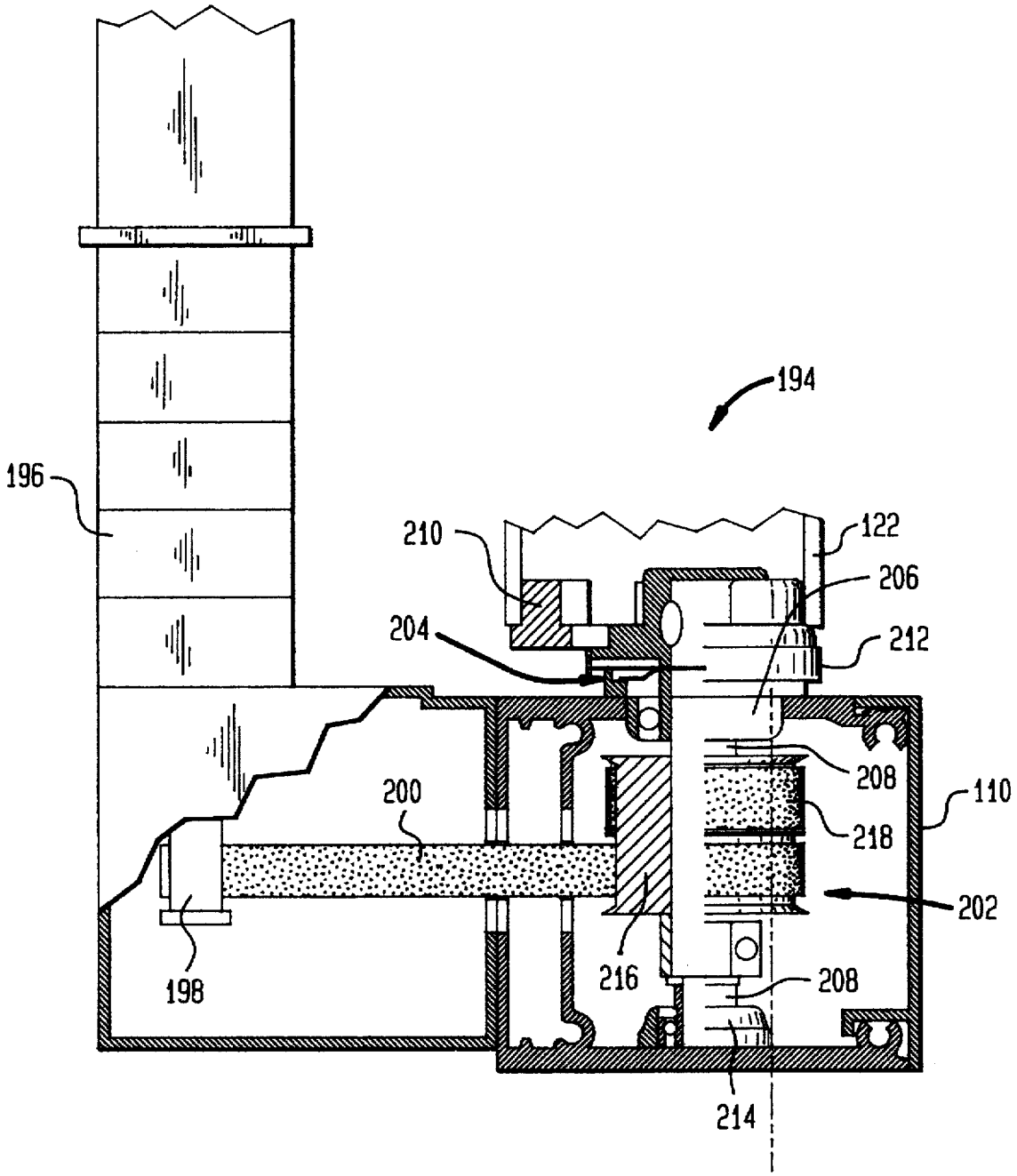
FIG. 6 is a partial cross-sectional view showing a motor assembly operative for rotating the display panels.
Figure 7:
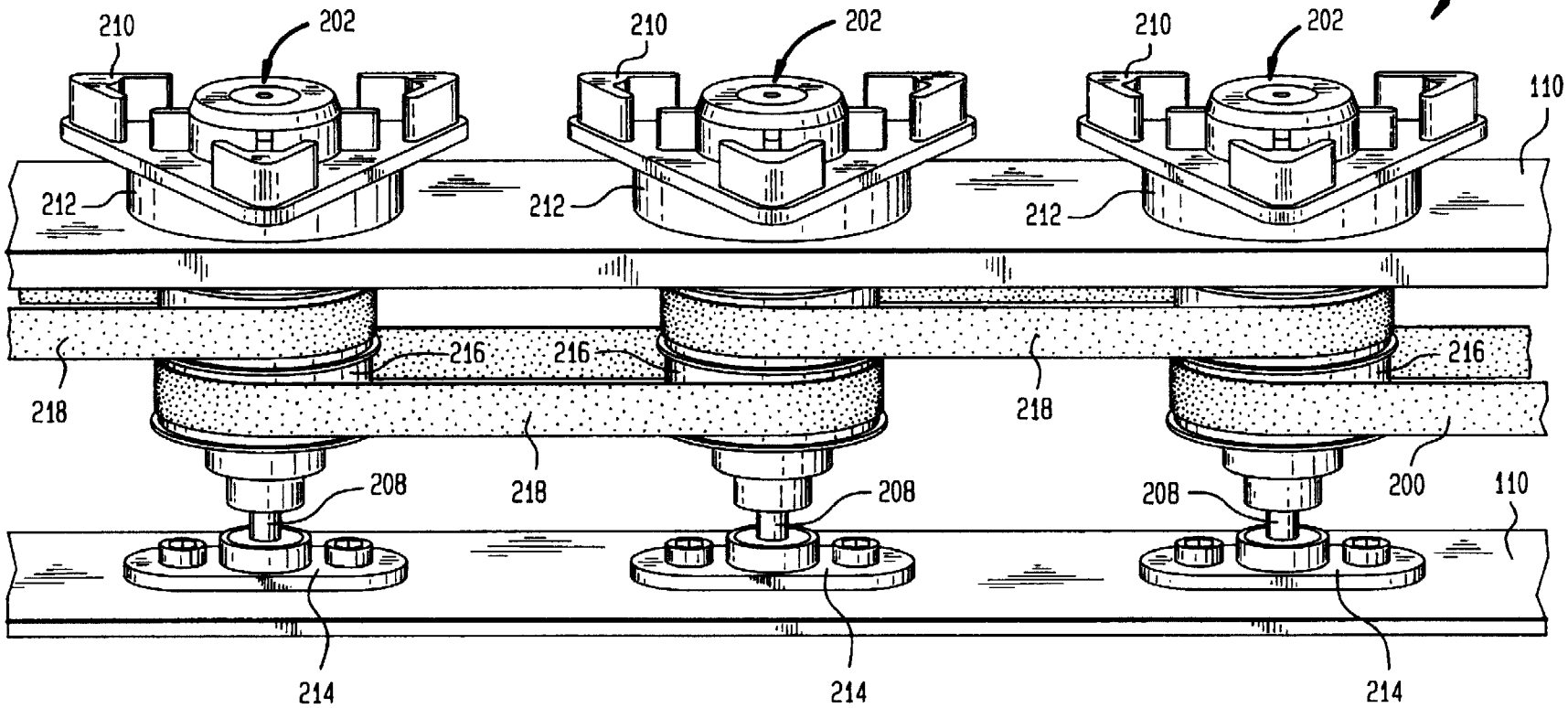
FIG. 7 is a perspective view of a drive system for the display panels.

By way of illustrative example, one arrangement and construction of a motor assembly 194 suitable for use in the display device 100 of the present invention is generally shown in FIGS. 6 and 7. The motor assembly 194 is constructed to include a motor housing 196 for supporting a motor/gear assembly (not shown) from which there extends a drive shaft 198. The drive shaft 198 is coupled via a drive belt 200 to the first of a series of display panel drive assemblies 202. Each of the drive assemblies 202 is constructed to include a journal assembly 204 which is of similar construction to journal assembly 176 as shown and described with respect to FIG. 5. In this regard, the journal assembly 204 is provided with a bearing 206 supported by the bottom member 110 of the frame 102 which rotationally supports a shaft 208 extending therethrough. The upper free end of the shaft 208 supports a load bearing carrier 210 above a spacer 212. The load bearing carrier 210 is of similar construction to load bearing carrier 186. Each of the load bearing carriers 210 are internally fitted into the lower open ends of the display panels 122 within the display areas 138, 146. The lower free end of the shaft 208 is journaled to the bottom member 110 of the frame 102 by means of a bearing 214. A double cog wheel 216 is secured to each of the shafts 208.

As shown in FIG. 7, the drive belt 200 is connected to the cog wheel 216 of the first drive assembly 202. Any number of drive assemblies 202 may be connected by a linking drive belt 218 which rotationally couple the cog wheels 216 of adjacent drive assemblies for simultaneous rotation therewith and the display panels 122. The aforementioned construction and arrangement of the motor assembly 194 enables a single motor to simultaneously rotate any number of a plurality of display panels 122 by means of the individual display panel drive assemblies 202. A similar construction of the display panel drive assemblies 202 is disclosed in Ahlgren, U.S. Pat. No. 4,189,859. It is therefore to be understood that other constructions for the display panel drive assemblies 202 may be employed with the present invention, for example, using direct gear arrangements as opposed to a drive belt system.

The display panels 122 within the top two display quadrants, i.e., display areas 132, 134, 140, 142 are driven by similarly constructed and arranged motor assemblies 194. The motor assemblies are identical to those previously described with respect to FIG. 6 and 7. In this regard, the display panel drive assemblies 202, as shown in FIG. 7, are turned upside down and mounted to the top member 108 of the frame 102. Each of the load bearing carriers 210 are internally fitted into the upper open ends of the display panels 122 within the display areas 132, 140. By arranging the display panel drive assemblies 202 at the top and bottom of the frame 102 for driving the display panels 122 at their extreme opposite ends, the display device will have a generally seamless appearance by minimizing the clearance space between adjacent display panels 122 as heretofore described. By way of example, it is contemplated that a gap of no greater than two inches will be required in the center of the display device which, for a given display device, will have a seamless appearance.

The individual motor assemblies 194 may be controlled by an electronic control system via a software programmed computer. As a result, the display device 100 can be operated remotely based upon a pre-program which can provide variable display times, night-time shutdown, controlled rotation of the display panels, and many other potential programmable features designed to meet the user's needs. Coupled with a appearance, the display device 100 of the present invention can be constructed in a variety of sizes and shapes to accommodate the need of the advertising, displaying multiple images of different scenes that may be pictorial, artistic or informational. In this regard, the display device does not have to be constructed as a flat device, but can be curved into any arced shape, circle or the like.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A display device for displaying changeable images, said device comprising a plurality of display members having upper and lower ends, said display members arranged in lower and upper areas providing a display area having a changeable image upon rotation of at least one of said display members, rotating means operatively coupled to the lower ends of said display members within said lower area and to the upper ends of said display members within said upper area for rotating at least one of said display members, said display members within one of said lower and upper areas comprising at least a pair of display members rotationally coupled in end-to-end relationship, whereby rotation of one of said display members of said pair causes rotation of the other said display member within said pair.

2. The display device of claim 1, wherein the upper ends of said display members in said lower area are arranged sufficiently adjacent the lower ends of said display members in said upper area whereby said display area has a seamless appearance between said lower and upper areas.

3. The display device of claim 1, further including support means for rotationally supporting the lower ends of said display members within said upper area and the upper ends of said display members within said lower area.

4. The display device of claim 3, wherein said support means enables the rotation of said display members within said upper area independently of said display members within said lower area.

5. The display device of claim 1, further including support means for rotationally supporting said pair of display members in said end-to-end relationship.

6. The display device of claim 1, wherein said rotating means comprises a plurality of motor assemblies each operatively coupled to select ones of said plurality of display members in said lower and upper areas, respectively.

7. The display device of claim 6, wherein said motor assemblies each comprise a motor and at least one drive belt and pulley coupled to a one of said plurality of said display member in said lower and upper areas for rotation thereof.

8. The display device of claim 1, further including images to be viewed on said plurality of display members.

9. A display device for displaying changeable images, said device comprising a plurality of first display members each having an axis, said first display members arranged in columns for rotation about their respective axes, a plurality of second display members each having an axis, said second display members arranged in columns for rotation about their respective axes, said first and second display members having upper and lower ends, said second display members arranged in adjacent end-to-end alignment with corresponding ones of said first display members thereby providing a display area having a seamless appearance between said first and second display members, support means for rotationally supporting the ends of said first and second display members which are aligned opposing each other, and rotating means operatively coupled to the lower ends of said first display members and the upper ends of said second display members for independent rotation of said first display members relative to said second display members, whereby said display area has a changeable image upon rotation of at least one of said first display members or said second display members, at least one of said first and second display members comprising at least a pair of display members rotationally coupled in end-to-end relationship, whereby rotation of one of said display members of said pair causes rotation of the other said display member within said pair.

10. The display device of claim 9, further including support means for rotationally supporting the lower ends of said second display members and the upper ends of said first display members.

11. The display device of claim 9, wherein said support means enables the rotation of said first display members independently of said second display members.

12. The display device of claim 9, further including support means for rotationally supporting said pair of display members in said end-to-end relationship.

13. The display device of claim 9, wherein said rotating means comprises a plurality of motor assemblies each operatively coupled to a pluralilty of first display members and a plurality of said second display members.

14. The display device of claim 13, wherein said motor assemblies each comprise a motor and at least one drive belt and pulley coupled to a display member for rotation thereof.

15. The display device of claim 9, further including images to be viewed on said plurality of first and second display members.

16. A display device having a seamless appearance for displaying a plurality of changeable images, said device comprising a frame, a plurality of elongated multi-sided first display members within said frame each having upper and lower ends, each of said first display members having a longitudinal rotational axis arranged in adjacent columns within a first row thereof, a plurality of elongated multi-sided second display members within said frame each having upper and lower ends, each of said second display members having a longitudinal rotational axis arranged in adjacent columns within a second row thereof, said second display members arranged in adjacent longitudinal alignment with corresponding ones of said first display members thereby providing a display area having a seamless appearance, means for rotationally supporting the ends of the longitudinally aligned first and second display members which are adjacent each other, first rotation means operatively coupled to the lower ends of said first display members for rotation thereof, and second rotation means operatively coupled to the upper ends of said second display members for rotation thereof independently of said first display members, whereby said display device has a changeable image upon rotation of at least one of said first and second display members, at least one of said first and second display members comprising at least a pair of display members rotationally coupled in end-to-end relationship, whereby rotation of one of said display members of said pair causes rotation of the other said display member within said pair.

17. The display device of claim 16, further including support means for rotationally supporting the lower ends of said second display members and the upper ends of said first display members.

18. The display device of claim 17, wherein said support means enables the rotation of said first display members independently of said second display members.

19. The display device of claim 16, further including support means for rotationally supporting said pair of display members in said end-to-end relationship.

20. The display device of claim 16, wherein said first and second rotation means each comprise a plurality of motor assemblies each operatively coupled to a plurality of said first display members and said second display members.

21. The display device of claim 20, wherein said motor assemblies each comprise a motor and at least one drive belt and pulley coupled to a display member for rotation thereof.

22. The display device of claim 16, further including images to be viewed on said plurality of first and second display members.

23. A method for changing images of a display device, said method comprising arranging a plurality of display members having upper and lower ends in lower and upper areas to provide a display area, rotating at least one of said display members in said lower area at the lower end thereof, rotating at least one of said display members in said upper area at the upper end thereof to change the image within said display area and arranging said display members in said lower area as at least a pair of display members rotationally coupled in end-to-end relationship, whereby rotation of one of said display members of said pair causes rotation of the other said display member within said pair.

24. The method of claim 23, further comprising arranging the upper ends of said display members in said lower area adjacent the lower ends of said display members in said upper area whereby said display area has a seamless appearance.

25. The method of claim 23, further comprising supporting a weight of said display members within said display area along at least three independent support members of a frame.

26. The method of claim 23, further comprising arranging the display members in said display area adjacent each other in columns in said upper and lower areas.

27. The method of claim 26, wherein said upper and lower areas each comprise rows of said display members.

28. The method of claim 23, wherein said display members in said upper area are rotatable independently of said display members in said lower area.

29. The method of claim 23, further including providing images to be viewed on said plurality of display members.

30. A method for changing images of a display device, said method comprising arranging a plurality of display members having upper and lower ends in lower and upper areas to provide a display area, rotating at least one of said display members in said lower area at the lower end thereof, rotating at least one of said display members in said upper area at the upper end thereof to change the image within said display area, and arranging said display members in said upper area as at least a pair of display members rotationally coupled in end-to-end relationship, whereby rotation of one of said display members of said pair causes rotation of the other said display member within said pair.

31. A display device having an uninterrupted viewable display area for displaying changeable images, said device comprising a plurality of display members having upper and lower ends, each of said display members having a plurality of image supporting surfaces viewable upon rotation of said display members, said display members arranged in lower and upper areas providing said viewable display area comprising said plurality of image supporting surfaces supporting a plurality of images thereon, said display area having a changeable viewable image upon rotation of a plurality of said display members within said lower and upper areas in order to display different ones of said image supporting surfaces, first rotating means operatively coupled to the lower ends of said display members within said lower area for selectively and simultaneously rotating a plurality of said display members within said lower area, second rotating means coupled to the upper ends of said display members within said upper area for selectively and simultaneously rotating a plurality of said display members within said upper area, whereby said first and second rotating means are operative for displaying different ones of said plurality of image supporting surfaces for changing the image viewable within said display area.

* * * * *

UNITED STATES PATENT AND TRADEMARK OFFICE

CERTIFICATE OF CORRECTION

PATENT NO. : 5,692,330

DATED : December 2, 1997

INVENTOR(S) : Tazwell L. Anderson, Jr.

It is certified that error appears in the above-identified patent and that said Letters Patent is hereby corrected as shown below:

Column 7, line 41, after "a" insert --seamless--.

Signed and Sealed this

Tenth Day of March, 1998

Bruce Lehman

*Attest:*

BRUCE LEHMAN

*Attesting Officer*

*Commissioner of Patents and Trademarks*